US006213371B1

(12) United States Patent
Cabrera

(10) Patent No.: US 6,213,371 B1
(45) Date of Patent: Apr. 10, 2001

(54) DEVICE FOR NAILING BASE SHEET FASTENERS

(76) Inventor: Pedro Cabrera, 1745 W. 31 Pl., Hialeah, FL (US) 33012

( * ) Notice: Subject to any disclaimer, the term of this patent is extended or adjusted under 35 U.S.C. 154(b) by 2 days.

(21) Appl. No.: 09/616,618

(22) Filed: Jul. 14, 2000

(51) Int. Cl.[7] ..... B25C 1/04

(52) U.S. Cl. ..... 227/8; 227/119; 227/120; 227/130

(58) Field of Search ..... 227/8, 120, 130, 227/119

(56) References Cited

U.S. PATENT DOCUMENTS 5,484,094 * 1/1996 Gupta ..... 227/8
5,791,546 * 8/1998 McGuinness et al. ..... 227/120
5,839,638 * 11/1998 Ronn ..... 227/8
5,921,454 * 7/1999 Arson et al. ..... 227/119
6,024,268 * 2/2000 Horng-Lin ..... 227/119

* cited by examiner

*Primary Examiner*—Scott A. Smith
(74) *Attorney, Agent, or Firm*—J. Sanchelima

(57) ABSTRACT

A device for base sheet fasteners used in conjunction with nail gun. The nail gun includes main and security triggers that a user has to simultaneously activate while lifting and dropping the nail gun. A slidable spring loaded longitudinal member is pushed back in line with the housing of a receiving assembly causing a leg to activate the safety trigger. This allows a user to place a base sheet fastener onto a magnetic hammer while the hammer is in the retracted position and upon dropping the nail gun, the magnetic hammer automatically strikes the surface thereby nailing the base sheet fastener in a safe and efficient manner. The resulting device permits the continuous installation of base sheet fasteners on a surface. A substantially cylindrical assembly is provided with a longitudinal cutout with cooperative dimensions to receive the base sheet fasteners.

7 Claims, 3 Drawing Sheets

DEVICE FOR NAILING BASE SHEET FASTENERS

II. BACKGROUND OF THE INVENTION

1. Field of the Invention

The present invention relates to a device for nailing base sheet fasteners, and more specifically, to a device to be used with a pneumatic nail gun.

2. Description of the Related Art

Presently when a user needs to affix base sheet fasteners to surfaces (flat), a heavy magnetized manual rod is used. The user places a base sheet fastener onto the magnetic tip of the rod, manually lifts the rod and then forcefully strikes the surface with the rod thereby affixing the base sheet fastener onto the surface. Instead of manually placing these base sheet fastener on surfaces, the present invention allows the user to automatically affix them in safe coordination with the operation and mechanism of a nail gun. The nail gun includes a trigger that a user continuously presses while lifting and dropping the nail gun, allowing the user to place a base sheet fastener onto the magnetic hammer while the hammer is in the retracted position and upon dropping the nail gun, the magnetic hammer automatically strikes the surface thereby fixating the base sheet fastener in a safe and efficient manner.

There are several nail gun designs in the prior art but to the best of applicant's knowledge, none of them include an automatic base sheet fastener dispenser for nail guns. One of these nail guns is manufactured by Hitachi Koky, under model No. NV45AB. Thus, the present invention increases the efficiency of a user performing this task.

III. SUMMARY OF THE INVENTION

It is one of the main objects of the present invention to provide a hammer for a nail gun to automatically nail base sheet fasteners onto a surface.

It is another object of this invention to provide a device that is safe and efficient to operate.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
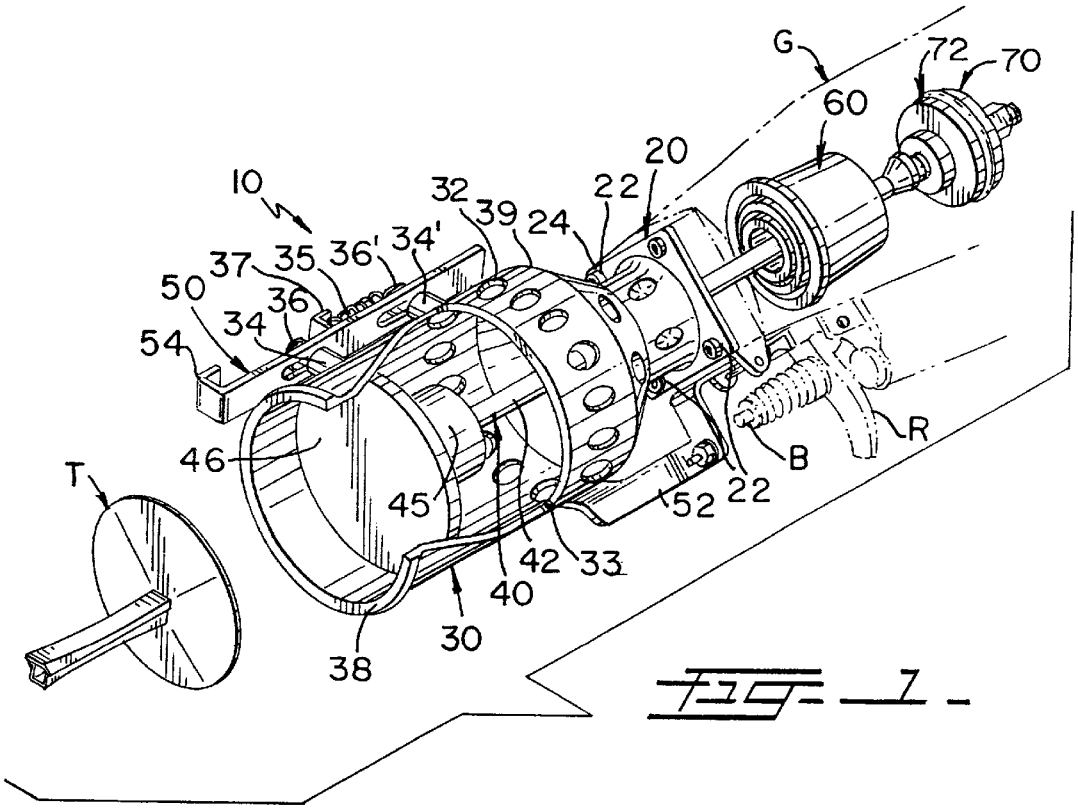
FIG. 1 is an isometric representation of the present invention mounted on a nail gun shown in phantom.

Referring now to the drawings, where the present invention is generally referred to with numeral 10, it can be observed that it basically includes plate 20, receiving assembly 30, hammer assembly 40, and trigger safety mechanism 50.

Figure 2:
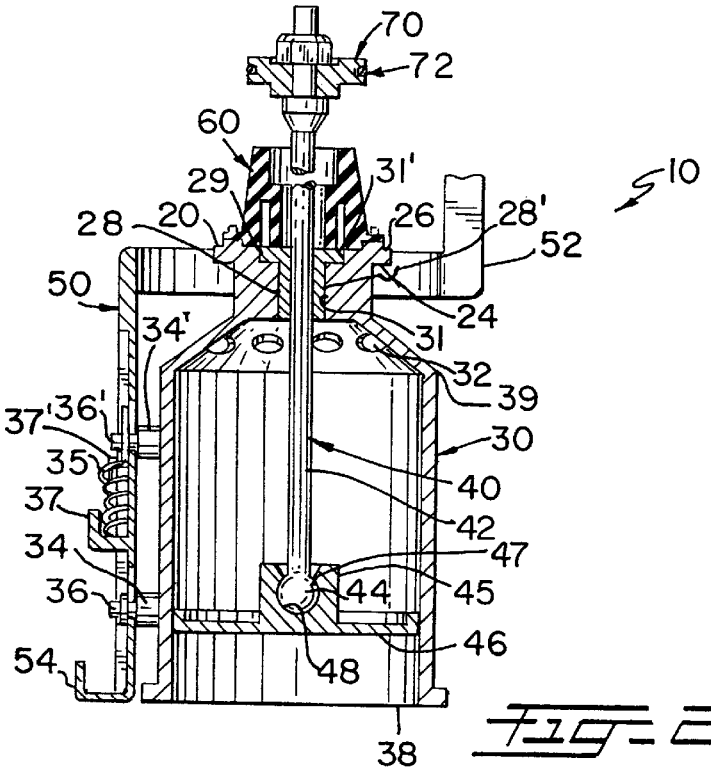
FIG. 2 is a cross sectional view taken from line 2—2 in FIG. 1.
Figure 3:
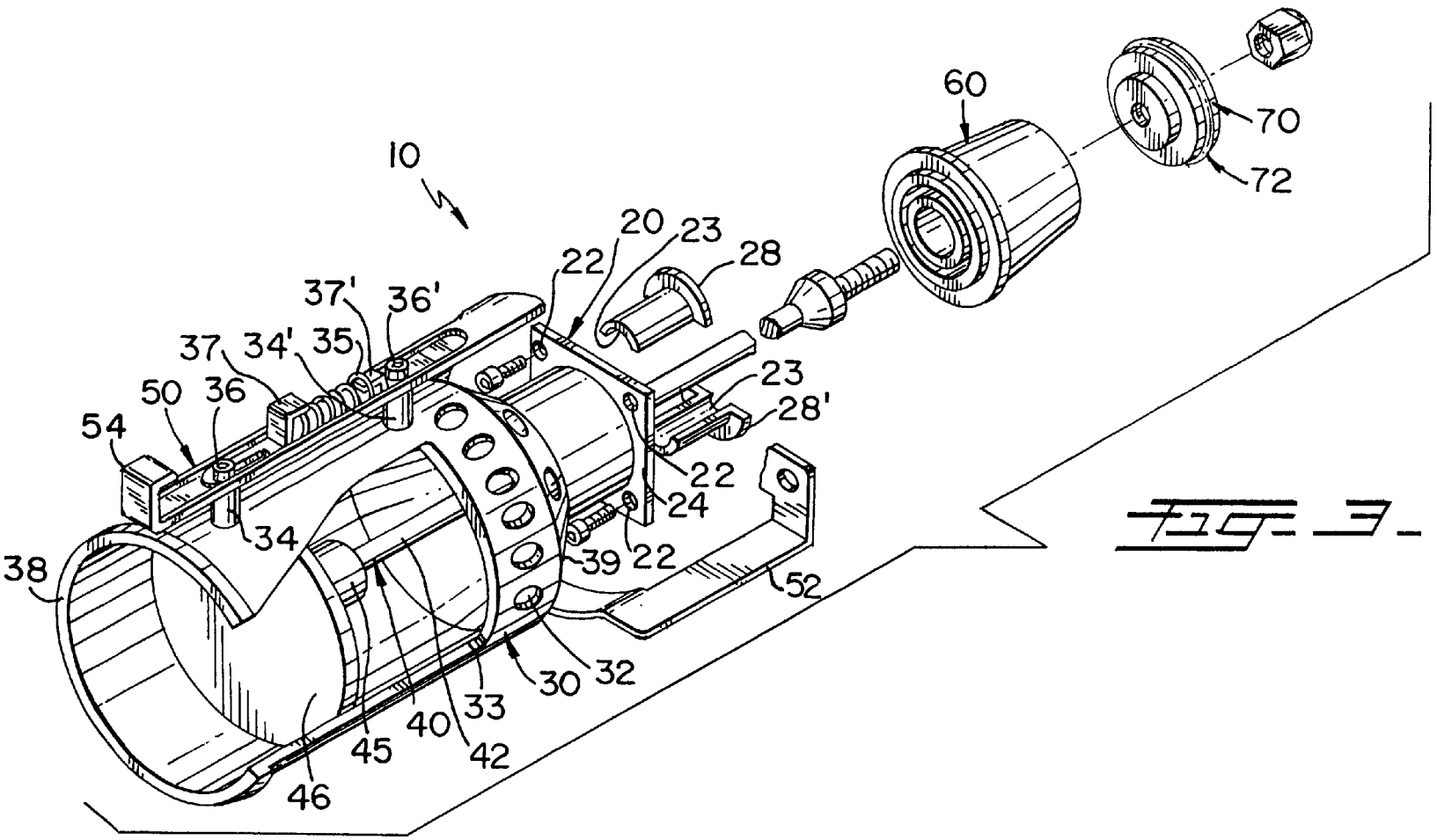
FIG. 3 is an exploded view of the present invention.
Figure 4:
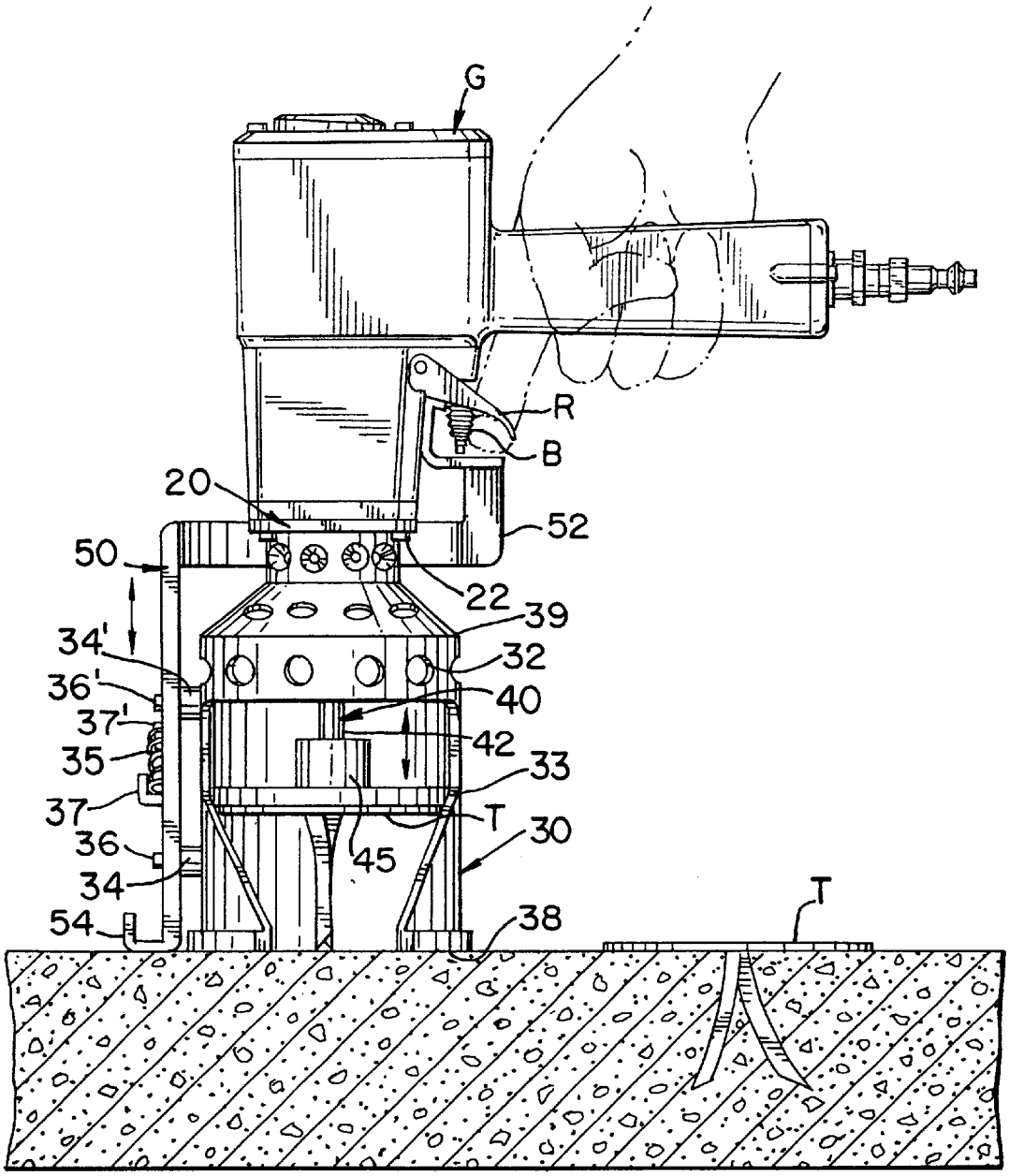
FIG. 4 is a cross sectional view of the invention during use.

As seen in FIG. 1, plate 20 has exterior face 24 and interior face 26 (shown in FIG. 2). In the preferred embodiment, plate 20 has a plurality of through holes 22 for attachments of screws, rivets, or similar devices, to removably secure plate 20 to nail gun G (shown in phantom).

Perpendicularly mounted to plate 20 is receiving assembly 30. Receiving assembly 30 is defined by end 38 and end 39 and has a partial cylindrical shape with a longitudinal curved cutout 33. Receiving assembly 30 is slightly larger in diameter than magnetic head 46 for a slidable fit. The magnetism tends to attract base sheet fasteners T to the proper place. Longitudinal curved cut-out 33 decreases approaching end 38, therefore the surface area closer to end 39 is smaller than that of end 38. This allows a user to place base sheet fasteners T through curved cutout 33 while hammer assembly 40 is in the retracted position. Base sheet fastener T is contained within receiving assembly 30. In the retracted position, magnetic head 46 is at a predetermined position nearest end 39 within receiving assembly 30. After hammer assembly 40 is actuated, magnetic head 46 automatically returns to its predetermined position nearest end 39 within receiving assembly 30. Through holes 32, near end 39, make nail gun G lighter and allow for the escape of air as magnetic head 46 returns to its predetermined position. Socket assembly 45 on back of magnetic head 46 pivotally keeps rounded tip 44 of shaft 42 in place. One end of shaft 42, the internal end, includes piston head assembly 70.

Slidably secured to the outer surface of receiving assembly 30 is trigger safety mechanism 50. Headed studs 34 and 34' are perpendicularly mounted to the outer surface of receiving assembly 30 and keep trigger safety mechanism 50 slidable in place. Stud heads 36 and 36' secure trigger safety mechanism on studs 34. Additionally stud heads 36 and 36' secure L-shaped plate 37 and plate 37' respectively. L-shaped plate 37 and plate 37' hold spring 35 in place. In the relaxed position, spring 35 are decompressed and tip 54 of trigger safety mechanism 50 slightly surpasses end 38 of cylindrical receiving assembly 30 a result, trigger safety mechanism leg 52 does not make contact with a safety button B on gun G. When a user presses trigger R of gun G and places end 38 on a surface, tip 54 and trigger safety mechanism 50 are pushed back, compressing spring 35 and causing trigger safety mechanism leg 52 to make contact with safety button B on gun G, thereby actuating the latter.

FIG. 2 shows a cross sectional view of the preferred embodiment. Piston head assembly 70 and impact absorption element 60 are parts found in common nail guns. Piston head assembly 70 is fixedly secured to shaft 42. O-ring 72 prevents air from escaping a pressurized area within nail gun G. When activated, piston head assembly 70 moves towards internal face 26. Absorption element 60 protects internal face 26 from piston head assembly 70.

Hammer assembly 40 is made of a durable material such as stainless steel, or equivalent. At the end of shaft 42 is rounded tip 44. Magnetic head 46 has cavity 47 and angled interior walls 48. Rounded tip 44 is snugly fitted inside cavity 47 of socket assembly 45. Concave interior walls 48 allow magnetic head 46 to swivel freely thereby allowing certain angular latitude for shaft 42 without breaking. Gun G can be positioned approximately between 0 to 10 degrees from the perpendicular line to targeted surface.

Plate 20 has interior face 26, exterior face 24 and aperture 29 for receiving half bushings 28 and 28' to rest thereon.

Half bushings 28 and 28' are identically shaped and each have a longitudinal central channel 23. When half bushings 28 and 28' are joined together, shaft 42 snugly fits within the resulting complemented longitudinal channel. Half bushings 28 and 28' are received by bore 31 and counter-bore 31'.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for base sheet fasteners on substantially flat surfaces, comprising:

A) a pneumatic nail gun assembly having a housing and a reciprocating shaft with first and second ends, and further including a main trigger assembly and a safety trigger assembly for actuating said shaft, and said first end including a piston head;

B) a hammer head pivotally mounted to said second end;

C) a receiving assembly having an outer surface and being rigidly mounted to said housing and coaxially housing said shaft and hammer head therein, said receiving assembly having a substantially cylindrical shape with a longitudinal cutout having cooperative dimensions to allow base sheet fasteners through; and D) a spring biased rigid elongated member slidably mounted to said outer surface and axially movable along said outer surface, said elongated member having third and fourth ends, said third end protrudes a predetermined distance longitudinally beyond said receiving assembly and said fourth end including a leg member that coacts with said safety trigger assembly upon the application of a predetermined force on said third end, so that said nail gun is activated when a user simultaneously actuates said main trigger assembly.

2. The device set forth in claim 1, wherein said nail gun assembly includes impact suppressing means for absorbing the force of said piston head.

3. The device set forth in claim 2, wherein said longitudinal cutout has its largest dimension in the portion adjacent to said nail gun and decreasing away from said nail gun so that the insertion of base sheet fasteners is facilitated.

4. The device set forth in claim 3, wherein said hammer head includes first and second surfaces, said first surface having a socket mounted thereon including a centrally disposed cavity, and said second end including a rounded tip pivotally trapped within said cavity.

5. The device set forth in claim 4 wherein said receiving assembly includes two complementary and symmetrical bushing members embracing a portion of said shaft.

6. A hammer for a nail gun, comprising:

A) a hammer assembly having a shaft with first and second ends, said first end extending inwardly to said nail gun a first predetermined distance and said second end including a rounded tip at a second predetermined distance, said rounded tip is received by magnetic head assembly, said magnetic head assembly free to angularly swivel between 0 and 10 degrees perpendicularly to surface;

B) a cylindrical receiving assembly having third and fourth ends and a longitudinal curved cut-out extending from said third end towards said fourth end a predetermined distance without reaching said fourth end, said longitudinal curved cut-out has greater surface area at said third end and decreases a predetermined amount towards said fourth end, said longitudinal curved cut-out having cooperative dimensions to receive said base sheet fastener;

C) a trigger safety mechanism having fifth and sixth ends, said fifth ends extending slightly beyond said third end and said sixth end adjacent to safety button on said nail gun, said trigger safety mechanism slidably mounted on studs fixedly secured onto said cylindrical receiving assembly, said studs having at least one spring member removably secured to said trigger safety mechanism, said spring member decompressed, keeping said trigger safety mechanism biased away from said safety button;

D) a plate assembly having inner and outer walls and a central through opening, said inner wall including a cutout with mating cooperative characteristics to receive spacers; and E) means for actuating said hammer assembly through trigger of said nail gun so that said fifth end and said third end are on a surface, said trigger safety mechanism is pushed back, compressing said spring thereby causing said sixth end of said trigger safety mechanism to make contact with said safety button of said nail gun, thereby actuating said hammer assembly, fixating said base sheet fastener on its intended surface.

7. The hammer for a nail gun set forth in claim 6, wherein said cylindrical receiving assembly has holes near said fourth end to allow for air escape and to lighten said nail gun.

* * * * *